US006018235A

United States Patent [19]

Mikuni

[11] Patent Number: 6,018,235

[45] Date of Patent: Jan. 25, 2000

[54] REFERENCE VOLTAGE GENERATING CIRCUIT

[75] Inventor: Takeshi Mikuni, Tokyo, Japan

[73] Assignee: NEC Corporation, Tokyo, Japan

[21] Appl. No.: 09/027,224

[22] Filed: Feb. 20, 1998

[30] Foreign Application Priority Data

Feb. 20, 1997 [JP] Japan ..... 9-036204

[51] Int. Cl.[7] ..... G05F 3/16

[52] U.S. Cl. ..... 323/313; 323/316; 323/280

[58] Field of Search ..... 323/313, 314, 323/315, 316, 273, 274, 280, 281

[56] References Cited

U.S. PATENT DOCUMENTS

| | | | |
|---|---|---|---|
| 4,857,823 | 8/1989 | Bitting | 323/314 |
| 5,610,506 | 3/1997 | McIntyre | 323/313 |
| 5,646,518 | 7/1997 | Lakshmikumar et al. | 323/316 |

FOREIGN PATENT DOCUMENTS 3-242715 10/1991 Japan .

*Primary Examiner*—Y. J. Han

*Attorney, Agent, or Firm*—Sughrue, Mion, Zinn Macpeak & Seas, PLLC

[57] ABSTRACT

A voltage control unit is provided to continuously monitor a reference output voltage by using a voltage monitoring circuit. When the reference output voltage is lower than a predetermined value, a pair of series transistors are turned ON by a detection output to thereby pull up the reference output voltage to the power supply voltage, and further to pull up the reverse phase input voltage to the reference output voltage. Then, the control is carried out in such a way that the reverse phase input voltage exceeds the normal phase input voltage. As a result, a reference voltage generating circuit is capable of providing a smooth ramp up voltage at power up or during any time the supply voltage is below the predetermined voltage.

22 Claims, 8 Drawing Sheets

REFERENCE VOLTAGE GENERATING CIRCUIT

BACKGROUND OF THE INVENTION

The present invention relates to a reference voltage generating circuit, and more specifically, to a reference voltage generating circuit for outputting a voltage equal to a band gap voltage multiplied by an integer by utilizing a forward direction voltage of a diode junction biased along a forward direction.

Normally, a power supply circuit element such as a 3-terminal regulator is used as a band gap reference voltage generating circuit. The band gap reference voltage generating circuit is a circuit which outputs a voltage equal to a band gap voltage X, an integer, by using a forward direction voltage of a diode junction biased along a forward direction in order to satisfy a very strict temperature compensation characteristic.

FIG. 8 is a circuit diagram for showing a conventional band gap reference voltage generating circuit. The circuit comprises a normal phase input voltage generating unit 11 for outputting a normal phase input voltage (VIN+), and a reverse phase input voltage generating unit 12 for outputting a reverse phase input voltage (VIN−). Also, the circuit comprises a voltage output unit 13 constructed of an operational amplifier OP11 for outputting a reference output voltage VOUT based on the normal phase input voltage VIN+ and the reverse phase input voltage VIN−, which are applied to a normal phase input terminal and a reverse phase input terminal, respectively. The circuit includes a resistor R10 for continuously supplying a power supply voltage VDD to the normal phase input voltage generating unit 11 and the reverse phase input voltage generating unit 12.

The normal phase input voltage generating unit 11 comprises a resistor R11 and diodes D11 and D12 connected in series in the forward direction from the reference output voltage VOUT in this order between the reference output voltage VOUT and the ground potential GND. The normal phase input voltage VIN+ is outputted from a connection node between the resistor R11 and an anode of the diode D11.

The reverse phase input voltage generating unit 12 comprises resistors R12 and R13 and diodes D13 and D14 connected in series from the reference output voltage VOUT in this order between the reference output voltage VOUT and the ground potential GND in parallel to the normal input voltage generating unit 11. The reverse phase input voltage VIN− is output from a connection point between the resistor R12 and the resistor R13.

These normal phase input voltage VIN+ and reverse phase input voltage VIN− are inputted to the normal phase input terminal and the reverse phase input terminal of the operational amplifier OP11, respectively. The reference voltage generating circuit can cancel the influence of the temperature coefficient of the diodes by selecting the resistors through R13. Therefore, the operational amplifier OP11 outputs the reference output voltage VOUT obtained by multiplying the band gap voltage whose temperature coefficient is substantially equal to zero by an integer (in this case, since two sets of diodes are employed, two times).

However, in such a conventional reference voltage generating circuit, when the power supply voltage VDD is raised, the power supply voltage VDD is merely applied through the resistor R10 to the normal phase input voltage generating unit 11 and the reverse phase input voltage generating unit 12. As a result, in the case where the power supply voltage VDD is gently raised, there is a problem that the reference output voltage VOUT becomes unstable during a time period until the power supply voltage VDD is reached to a preselected value.

FIG. 9 is a waveform chart for indicating the operations of the conventional reference voltage generating circuit. A solid line shows a desirable reference output voltage, and a broken line indicates the conventional reference output voltage VOUT.

Generally speaking, operational amplifiers and resistors, and the like, each have their own manufacturing fluctuations (differences) in their electric characteristics. In particular, in the conventional reference voltage generating circuit (see FIG. 8), when either the fluctuation in the input offset voltage of the operational amplifier OP11 or the fluctuations in the resistance values of the resistors R11 to R13 cause the voltage VIN− to be higher than the voltage VIN+, the following problem occurs. When the power supply voltage VDD is gradually raised, during the time period until the power supply voltage VDD has reached a predetermined value, the reference output voltage VOUT is increased with the power supply voltage VDD, so that the desirable stable characteristic (solid line) could not be obtained, but, as indicated in the broken line, the generation of the reference output voltage is delayed from the power supply voltage, resulting in an unstable state. Therefore, because the voltage VIN− is higher than the voltage VIN+, the amplifier OP11 outputs the voltage GND as the voltage VOUT.

On the other hand, a reference voltage generating circuit is disclosed in Japanese laid-Open patent Application No. 3-242715. FIG. 10 shows a circuit diagram for showing a reference voltage generating circuit disclosed in the Application No. 3-242715.

The reference voltage generating circuit has deleted the resistance R10 and added a P-channel transistor 18 and a level detecting circuit 17, compared to the circuit shown in FIG. 8. The transistor 18 is coupled between the power supply voltage VDD and the resistance R11. The level detecting circuit 17 has an input terminal connected to a connecting node of the transistor 18 and the resistance R11 and an output terminal connected to a gate of the transistor 18. Operations of this reference voltage generating circuit will now be explained.

At start up, the output voltage VOUT is almost Ov. At that time, the voltage detecting circuit 17 detects the level of the output voltage VOUT (Ov) and activates the transistor 18. Consequently, the output voltage VOUT is raised. When the output voltage VOUT is raised over a predetermined voltage, the detecting circuit 17 detects the voltage level and deactivates the transistor 18.

However, the reference voltage generating circuit disclosed by Japanese Application No. 3-242715 also has the same problem as the circuit shown in FIG. 8. That is, the circuit shown in FIG. 10 has a problem in a case that either the fluctuation in the input offset voltage of the operational amplifier OP11 or the fluctuations in the resistance values of the resistors R11 to R13 cause the voltage VIN− to be higher than the voltage VIN+.

SUMMARY OF THE INVENTION

It is therefore an object to provide a reference voltage generating circuit capable of obtaining a stable reference output voltage even when the power supply voltage VDD is gently raised.

To achieve such an object, a reference voltage generating circuit, according to the present invention, is comprised of:

a normal phase input voltage generating unit provided between the reference output voltage and the ground potential, having "in" ("n" being an integer greater than, or equal to 1) pieces of diode junctions series-connected under forward direction bias, and for outputting a predetermined normal phase input voltage; a reverse phase input voltage generating unit provided between the reference output voltage and the ground potential, having "n" pieces of diode junctions series-connected under forward directions bias, and for outputting a predetermined reverse phase input voltage; a voltage output unit provided between a power supply voltage and the ground potential, having an operational amplifier with a normal phase input terminal and a reverse phase input terminal, into which a normal phase input voltage and a reverse phase input voltage are inputted, and for outputting a desirable reference output voltage based on this output; and a low voltage control unit for pulling up the reference output voltage to the power supply voltage, and for controlling the reverse phase input voltage to be set at a potential higher than the normal phase input voltage when the reference output voltage is lower than a predetermined value.

Accordingly, in the case that the reference output voltage is lower than a predetermined value when the power supply voltage is raised, in the low voltage control unit, the reference output voltage is pulled up to the power supply voltage, and the reverse-phase input voltage is maintained at the potential higher than the normal phase input voltage, so that the reference output voltage output is substantially equal to the power supply voltage. As a result, a reference voltage generating circuit is capable of providing a smooth ramp up voltage at power up or during any time the supply voltage is below a predetermined voltage.

BRIEF DESCRIPTION OF THE DRAWINGS

The above and other objects, advantages and features of the present invention will be apparent from the following description taken in conjunction with the accompanying drawings, in which.

DETAILED DESCRIPTION OF THE PREFERRED EMBODIMENT

Figure 1A:
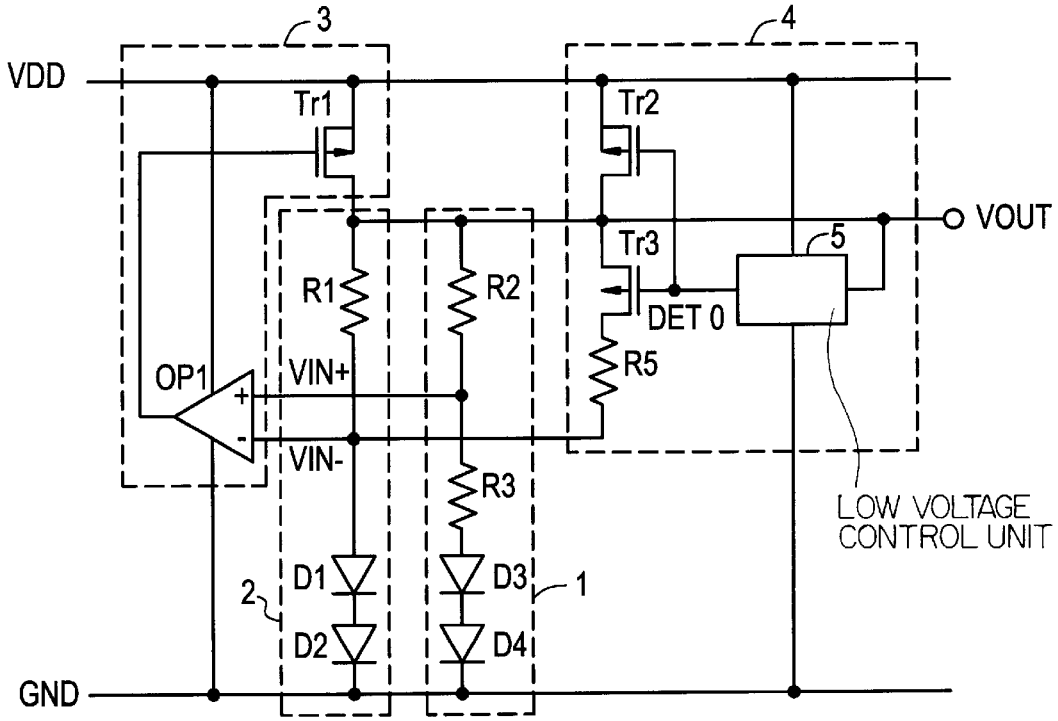
FIGS. 1A and 1B are circuit diagrams for showing a reference voltage generating circuit according to a first embodiment of the present invention.
Figure 1B:
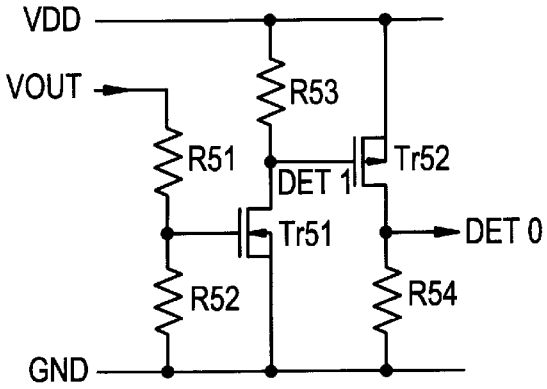

FIGS. 1A–B and 2A–B illustrate a first embodiment of the present invention FIG. 1A shows a reference voltage generating circuit, and FIG. 1B shows a detailed circuit for the voltage monitoring circuit 5 shown in the reference voltage generating circuit. The reference voltage generating circuit comprises a normal phase input voltage generating unit 1 for outputting a normal phase input voltage VIN+, a reverse phase input voltage generating unit 2 for outputting a reverse phase input voltage VIN−, a voltage outputting unit 3, and a low voltage control unit 4.

The normal phase input voltage generating unit 1 comprises resistors R2 and R3 and diodes D3 and D4 connected in series along the forward direction from the reference output voltage VOUT between the reference output voltage VOUT and the ground potential GND. A normal phase input voltage VIN+ is outputted from a connection point between resistor R2 and resistor R3.

The reverse phase input voltage generating unit 2 includes a resistor R1 and diodes D1 and D2 connected in series along the forward direction from the reference output voltage VOUT between the reference output voltage VOUT and the ground potential GND, and is parallel to the normal phase input generating unit 1. A reverse phase input voltage VIN− is outputted from a connection point between resistor R1 and an electrode of diode D1.

The voltage output unit 3 includes an operational amplifier OP1 for outputting a reference output voltage VOUT based on the normal phase input voltage VIN+ and the reverse phase input voltage VIN−, which are applied to a normal phase input terminal and a reverse phase input terminal, respectively. The voltage output unit 3 also includes a P-channel MOS transistor Tr1, operable in response to the output of the operational amplifier OP1, and connected between the power supply voltage VDD and the reference output voltage VOUT.

The circuit of the present invention further includes a low voltage control unit 4 which continuously monitors the reference output voltage VOUT. When the reference output voltage VOUT is lower than a predetermined value, the low voltage control unit 4 applies the power supply voltage VDD to both the normal phase input voltage generating unit 1 and the reverse phase input voltage generating unit 2, and controls in such a manner that the reverse phase input voltage VIN− exceeds the normal phase input voltage VIN+.

The low voltage control unit 4 includes a voltage monitoring circuit 5 for continuously monitoring the voltage of the reference output voltage VOUT and for outputting a detection output DET0 when this voltage is lower than a predetermined value. The unit 4 further includes a P channel MOS transistor Tr2 being turned ON in response to the detection output DET0 and connected between the power supply voltage VDD and the reference output voltage VOUT, a P channel MOS transistor Tr3 being turned ON in response to the detection output DET0 and connected between the reference output voltage VOUT and the output terminal of the reverse phase input voltage generating unit 2, namely the reverse phase input terminal of the operational amplifier 1, through a resistor R5 for limiting current.

One example of a voltage monitoring circuit 5 is shown in FIG. 1B and comprises resistors R51 and R52 for dividing the reference output voltage VOUT, N channel MOS transistor Tr51 operated in response to an output produced by the resistors R51 and R52, a resistor R53 for pulling up an output DET1 of the transistor Tr51 to the power supply voltage VDD, a P channel MOS transistor Tr52 operated in response to the output DET1 of the transistor Tr51, and a resistor R54 for pulling down an output of the transistor Tr52 to the ground potential.

As a result, a predetermined value of the reference output voltage monitored by the voltage monitoring circuit 5 is determined from a divisional voltage produced by the resistors R51 and R52 and the threshold voltage Vth of the transistor Tr51.

Also, the predetermined voltage is set to a voltage which is lower than a desirable reference output voltage outputted during the normal operation by which the normal phase input voltage generating unit 1, the reverse phase input voltage generating unit 2, and the voltage output unit 3 can be operated under normal condition.

Figure 2A:
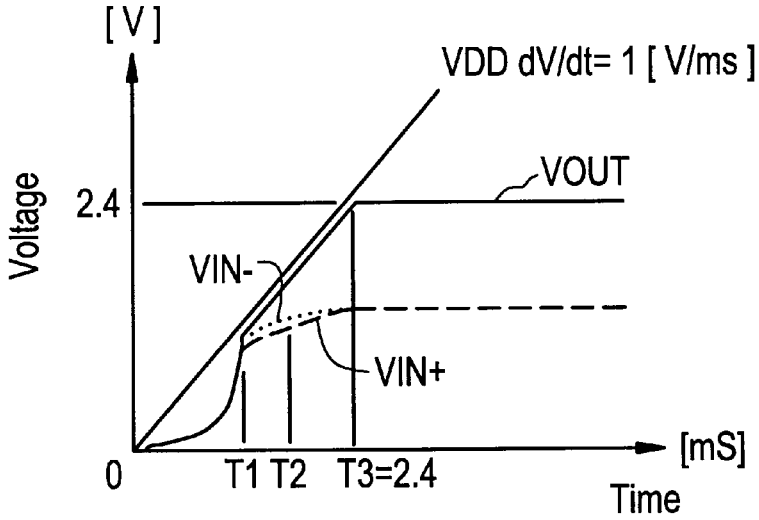
FIGS. 2A and 2B are signal waveform diagrams for indicating operations of the reference voltage generating circuit according to the first embodiment of the present invention.
Figure 2B:
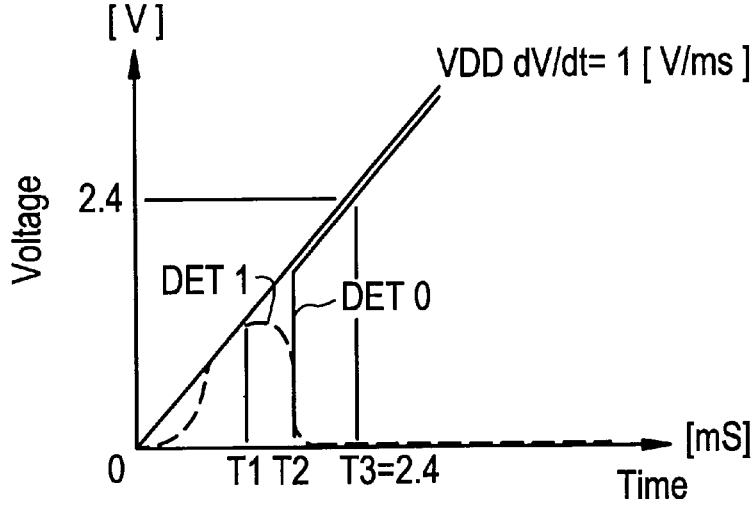

FIGS. 2A and 2B illustrate the operations of the first embodiment according to the present invention. FIG. 2A shows the normal phase input voltage VIN+, the reverse phase input voltage VIN−, and the reference output voltage VOUT. FIG. 2B shows the detection outputs DET0 and DET1 of the voltage monitoring circuit 5. The X axis indicates time [millisecond] and the Y axis indicates voltage [V].

As an example, 2.4 V is selected as the normal value of the reference output voltage VOUT and the power supply voltage VDD increases 1 V per 1 ms as will be explained below. Just after the supply of the power supply voltage VDD is started from a time instant T0, the power supply voltage VDD is not sufficiently increased. Therefore, when this power supply voltage VDD is lower than, or equal to, the forward direction voltages of the diodes D1, D2 and of the diodes D3, D4, for example, 1.4 volts, neither the normal phase input voltage generating unit 1 nor the reverse phase input voltage generating unit 2 are operated.

Also, during that time, a voltage is not applied to the gate of the transistor Tr51 of the voltage monitoring circuit 5, so transistor Tr51 is not sufficiently turned ON and remains OFF. As a result, the detection output DET1 becomes substantially equal to the power supply voltage VDD by the resistor R53, transistor Tr52 is in an OFF state and the detection output DET0 becomes equal to the ground potential GND by the resistor R54. Therefore, the transistor Tr2 is turned ON in response to the detection output DET0 having the same potential as this ground potential GND to thereby pull up the reference output voltage VOUT to the power supply voltage VDD. However, since a sufficient gate-to-source voltage is not applied to the transistor Tr2, this transistor Tr2 cannot be completely turned ON. As a consequence, the reference output voltage VOUT is at a potential which is substantially equal to an intermediate potential between the power supply voltage VDD and the ground potential GND. It is noticed that the transistor Tr1 does not need to be completely OFF during this period. That is, the transistor Tr1 is not effecting against the movement of a whole circuit because transistor Tr2 mainly contributes to the output voltage VOUT rising to a voltage substantially equal to the power supply voltage VDD.

Thereafter, at a time instant T1, the power supply voltage VDD is increased higher than, or equal to the forward direction voltages of the diodes D1, D2 and of the diodes D3, D4. Thus, these diodes D1 to D4 are gradually turned ON, so that both the normal phase input voltage generating unit 1 and the reverse phase input voltage generating unit 2 are operable. Under this condition, since the reference output voltage VOUT is not sufficiently increased, the transistors Tr51 and Tr52 of the voltage monitoring circuit 5 remain OFF. Therefore, the potential of the detection output DET0 remains at substantially the same potential of the ground potential GND and the transistors Tr2 and Tr3 are maintained in ON states. As a consequence, the reverse phase input voltage VIN− derived from the reverse phase input voltage generating unit 2 is pulled up to the reference output voltage VOUT through the transistor Tr3 and the resistor R5. Therefore, the reverse phase input voltage VIN− is kept at a potential higher than the normal phase input voltage VIN+. Accordingly, the output derived from the operational amplifier OP1 becomes the ground potential GND, and the transistor Tr1 is turned ON, and further the reference output voltage VOUT is increased to having a value substantially equal to the power supply voltage VDD.

At a time instant T2, the reference output voltage VOUT is sufficiently increased, so that the transistors Tr51 and Tr52 of the voltage monitoring circuit 5 are turned ON, and thus the detection output DET0 becomes substantially equal potential to the power supply voltage VDD, and the transistors Tr2 and Tr3 are turned OFF. In response to this operation, the pulling-up operation by the transistor Tr2 for the reference output voltage VOUT and the pulling-up operation by the transistor Tr3 for the reverse phase input voltage VIN− stop. Since the reference output voltage VOUT has not reached the desirable value, the reverse phase input voltage VIN− is kept at a higher potential than the normal phase input voltage VIN+ by the operations of the normal phase input voltage generating unit 1 and of the reverse phase input voltage generating unit 2. That is why the ratio of the resistances R1, R2, and R3 are set up so that the voltage VIN− is higher than the voltage VIN+ when the voltage Vout is lower than the predetermined voltage and the voltage VIN+ is higher than the voltage VIN− when the voltage VOUT is higher than the predetermined voltage. As a consequence, the output from the operational amplifier OP1 becomes the ground potential GND, the ON state of the transistor Tr1 is maintained, and the reference output voltage VOUT is increased having a value substantially equal to the power supply voltage VDD.

Next, at a time instant T3, the reference output voltage VOUT is increased up to a desirable value (e.g., 2.4 V), so that the normal phase input voltage VIN+ outputted from the normal phase input voltage generating unit 1 becomes equal to the reverse phase input voltage VIN− outputted from the reverse phase input voltage generating unit 2, the output from the operational amplifier OP1 is kept to a preselected voltage value, and the reference output voltage VOUT can be maintained at the desired value.

Figure 8:
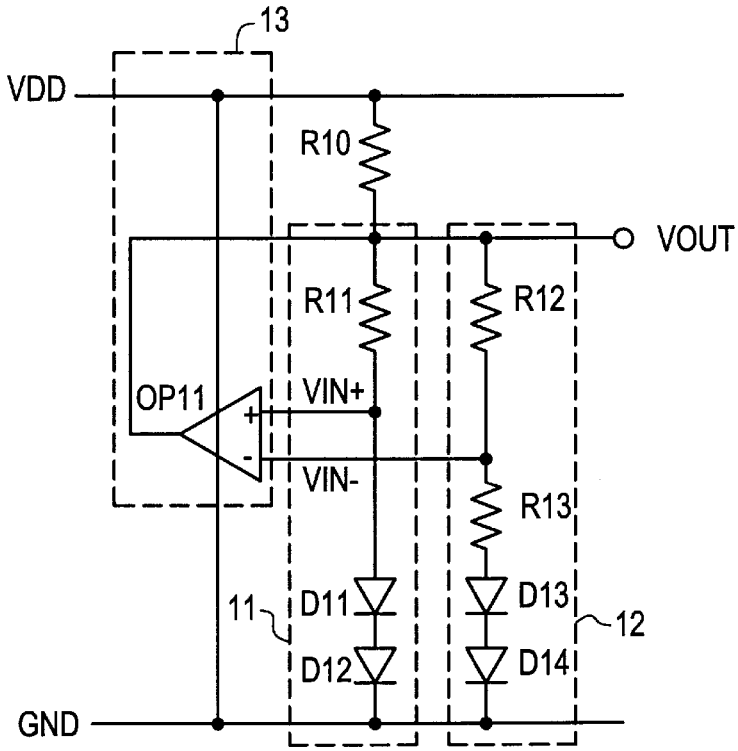
FIG. 8 PRIOR ART
FIG. 8 is a circuit diagram for showing a conventional reference voltage generating circuit.
Figure 9:
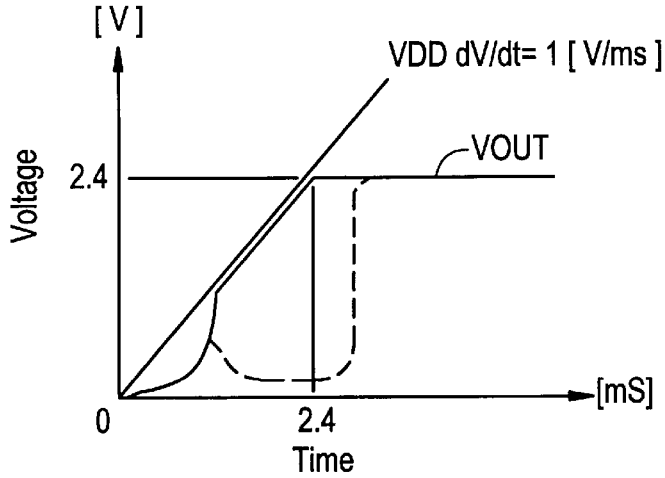
FIG. 9 PRIOR ART
FIG. 9 is a signal waveform diagram for representing the conventional reference voltage generating circuit.
Figure 10:
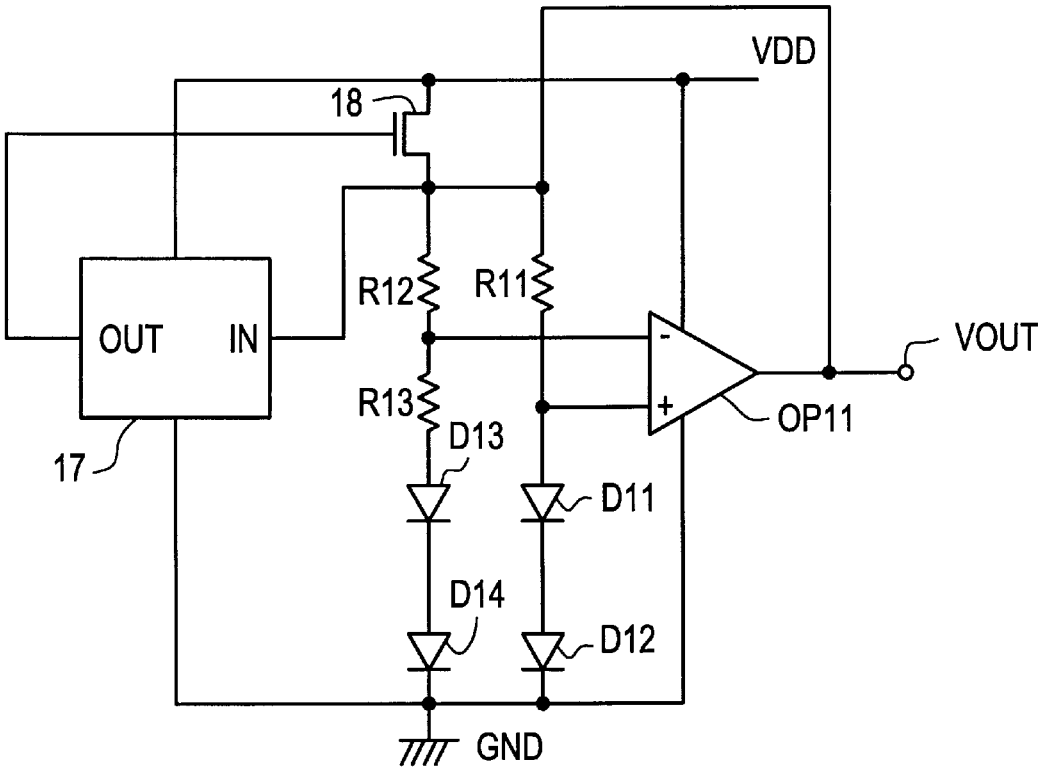
FIG. 10 PRIOR ART
FIG. 10 is a circuit diagram for showing another conventional reference voltage generating circuit.

As described above, low voltage control unit 4 is employed so as to continuously monitor the reference output voltage VOUT so that when the reference output voltage VOUT is lower than a predetermined value, the power supply voltage VDD is applied to the normal phase input voltage generating unit 1 and the reverse phase input voltage generating unit 2, and the reverse phase input voltage VIN− exceeds the normal phase input voltage VIN+. Accordingly, even when the power supply voltage VDD is gradually increased, it is possible to obtain the stable output whose potential is increased up to substantially the same potential as the power supply voltage VDD until the reference output voltage VOUT is reached to the desirable value (e.g., 2.4 V), as compared with the conventional reference voltage generating circuit (see FIGS. 8 and 9). On the other hand, in the conventional circuit, when the power supply voltage VDD is raised, the power supply voltage VDD is merely applied to the normal phase input voltage generating unit 1 and the reverse phase input voltage generating unit 2.

Also, in the voltage output unit 3, the transistor Tr1 is provided between the power supply voltage VDD and the reference output voltage VOUT. The transistor Tr1 is driven by a very small current supplied from the operational amplifier OP1 to thereby output the reference output voltage VOUT. As a consequence, the current consumed at the output stage of the operational amplifier OP1 is reduced.

Figure 3:
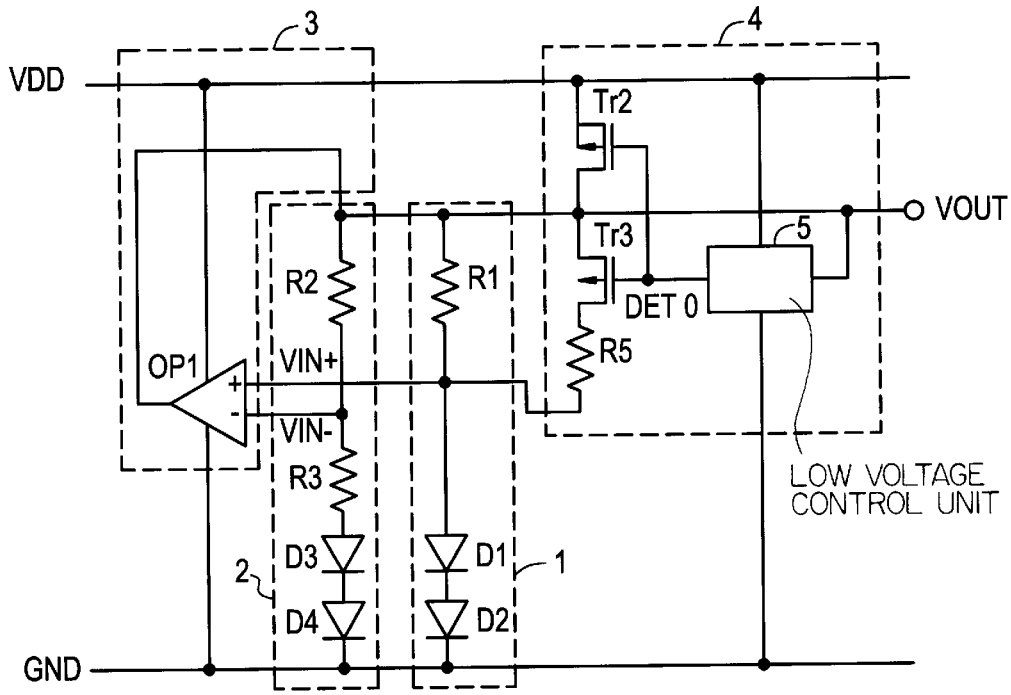
FIG. 3 is a circuit diagram for showing a reference voltage generating circuit according to a second embodiment of the present invention.

A second embodiment is shown in FIG. 3. The arrangement of this voltage output unit may be made by employing fewer circuit components by directly using the output of the operational amplifier OP1 as the reference output voltage VOUT. In this alternative case, since no transistor Tr1 is employed, the output of the operational amplifier OP1 must be inverted. Thus, the circuit arrangement of the normal phase input voltage generating unit 1 includes a resistance element R1 and diodes D1 and D2, and the reverse phase input voltage unit 2 includes the resistance elements R2 and R3, diodes D3 and D4, rather than the above-described circuit arrangements (see FIG. 1). That is why, when the power supply voltage VDD raises, resistance value of the resistance elements R1 through R3 are set so that the voltage VIN+ is higher than the voltage VIN−, thereby the amplifier OP1 outputs a voltage substantially the same as the power supply voltage VDD.

Also, in the low voltage control unit 4, the series-connection circuit made of the transistor Tr3 and the resistor R5 is provided between the reference output voltage VOUT and the output terminal of the normal phase input voltage generating unit 1, namely the normal phase input terminal of the operational amplifier OP1 to thereby pull up the normal phase input voltage VIN+ to the reference output voltage VOUT when the reference output voltage VOUT is lower than a predetermined voltage. As a result, since this pull up current may flow through the transistors Tr2 and Tr3 and the resistor R5, the pull up current can be reduced.

Figure 4:
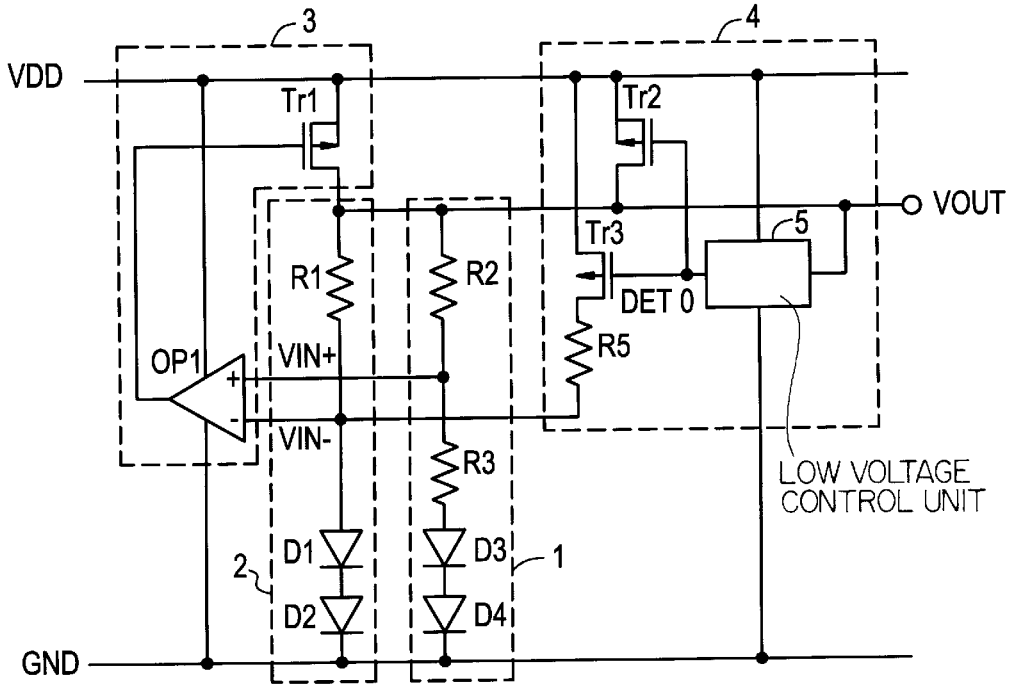
FIG. 4 is a circuit diagram for showing a reference voltage generating circuit according to a third embodiment of the present invention.

A third embodiment is shown in FIG. 4. The series-connection circuit made of the transistor Tr3 and the resistor R5 may be alternatively provided between the power supply voltage VDD and the output terminal of the reverse phase input voltage generating unit 2. Accordingly, the reverse phase input voltage VIN− may be held at a higher potential than the normal phase input voltage VIN+ and a more stable control is achieved.

Figure 5A:
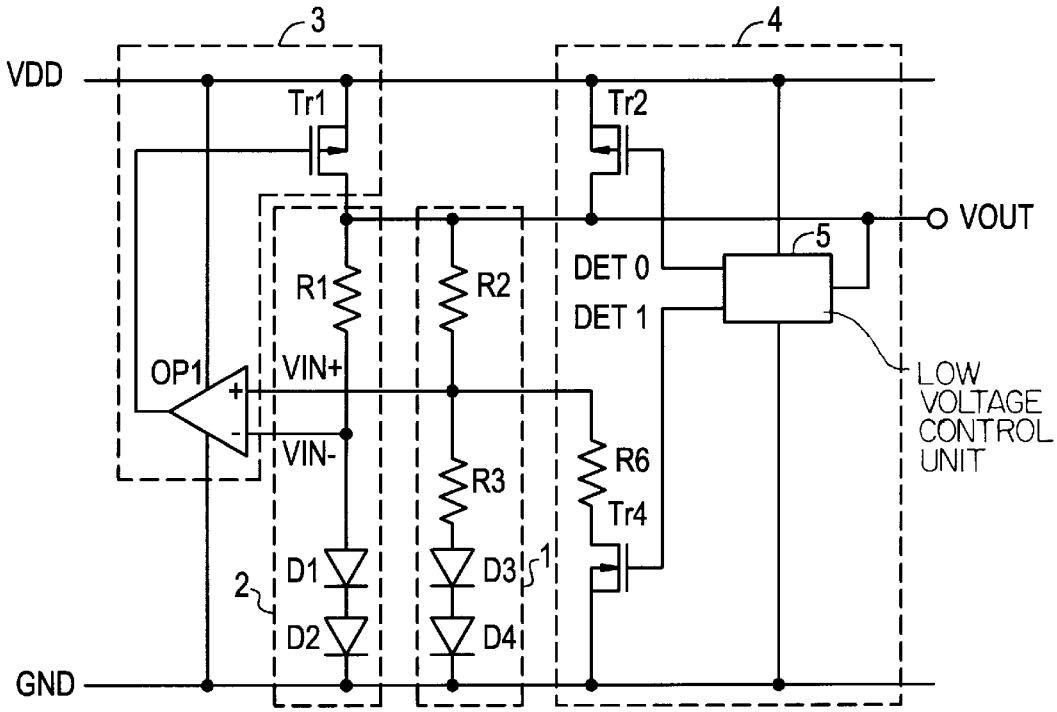
FIGS. 5A and 5B are circuit diagrams for indicating a reference voltage generating circuit according to a fourth embodiment of the present invention.
Figure 5B:
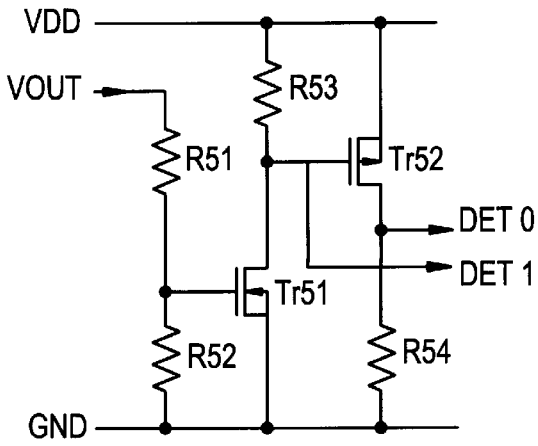

FIGS. 5A and 5B illustrates a fourth embodiment of the present invention. FIG. 5A illustrates another example of an entire reference voltage generating circuit. FIG. 5B illustrates another example of a voltage monitoring circuit 5. In particular, the arrangement of a low voltage control unit 4 is different from that of the first embodiment. In these figures, the same reference numerals shown in FIG. 1 will be employed as those for indicating the same, or similar portions.

In the first embodiment of the present invention (see FIG. 1), the means for holding the reverse phase input voltage VIN+ at the potential exceeding the normal phase input voltage VIN+, i.e., the series-connection circuit constructed of the transistor Tr3 and the resistor R5, is provided between the reference output voltage VOUT and the output terminal of the reverse phase input voltage generating unit 2, namely the reverse phase input terminal of the operational amplifier OP1. On the other hand, in the embodiment shown in FIGS. 5A and 5B, a series-connection circuit constituted by a transistor Tr4 and a current limiting resistor R6 is provided between the output terminal of the normal phase input voltage generating unit 2, namely the normal phase input terminal of the operational amplifier OP1, and the ground potential GND. As such, the reverse phase input voltage VIN− is held at a potential exceeding the normal phase input voltage VIN+ by way of the transistor Tr4, an N channel MOS transistor. A detection output DET1 for driving the transistor Tr4 is supplied from a connection point between the transistor Tr51 and the resistor R53 from the voltage monitoring circuit 5.

A further explanation of this embodiment is omitted because operations in this case are substantially similar to those as previously explained, and as apparent from the foregoing description of the first embodiment, a similar effect is achieved.

In the above-mentioned descriptions, in the normal phase input voltage generating unit 1 and the reverse phase input voltage generating unit 2, two sets of the diodes D1, D2 and D3, D4 have been series-connected to each other in the forward direction. However, the present invention is not limited to this example, and 3 diodes or more may be employed to construct a series-connection arrangement. Similar effects would also be achieved. Furthermore, the present invention may be applied to only a single diode, e.g., diodes D1 and D3. However, in that case, it is necessary to constitute a reference voltage generating circuit such that the amplifier OP1 is operatable even though a voltage step of only one diode is used. For example, when a transistor, e.g. an N type MOS transistor having a threshold voltage Vth, is used in the amplifier OP1, the threshold voltage Vth of the N type MOS transistor must be lower than a voltage VF of a diode to be able to operate amplifier OP1. Further, the diodes may be elements having the diode junction (pn junction) or, for instance, a transistor may be employed.

The above case has also been described such that the output terminal of the reverse phase input voltage generating unit 2, namely the reverse phase input terminal of the operational amplifier OP1 is pulled up by the transistor Tr3 in the low voltage control unit 4. However, the present invention is not limited thereto. Alternatively, if there is such a connection point capable of holding the reverse phase input voltage VIN− higher than the normal phase input voltage VIN+, then any one of the connection points for the reverse phase input voltage generating unit 2 may be pulled up. This general concept may be similarly applied to the second embodiment in which the output terminal of the normal phase input voltage generating unit 1, namely the normal phase input terminal of the operational amplifier OP1 is pulled down by the transistor Tr4.

It should also be noted that in the above-described case, the reference voltage generating circuit is operated by the power supply voltage VDD equal to the positive voltage with respect to the ground potential GND. The present invention is not limited to this case, but may be modified for use with a negative voltage power supply. As illustrated in FIGS. 6A and 6B and FIGS. 7A and 7B, the reference voltage generating circuit may be operated by another power supply voltage VSS equal to a negative voltage with respect to the ground potential GND. These reference voltage generating circuits are operable by the negative power supply voltage VSS and correspond to the above-described reference voltage generating circuits operable by the positive power supply voltage VDD. The same reference numerals will be employed as those for denoting similar elements and/or functions as the above-explained circuit portions of FIGS. 1 and FIGS. 3.

Figure 6A:
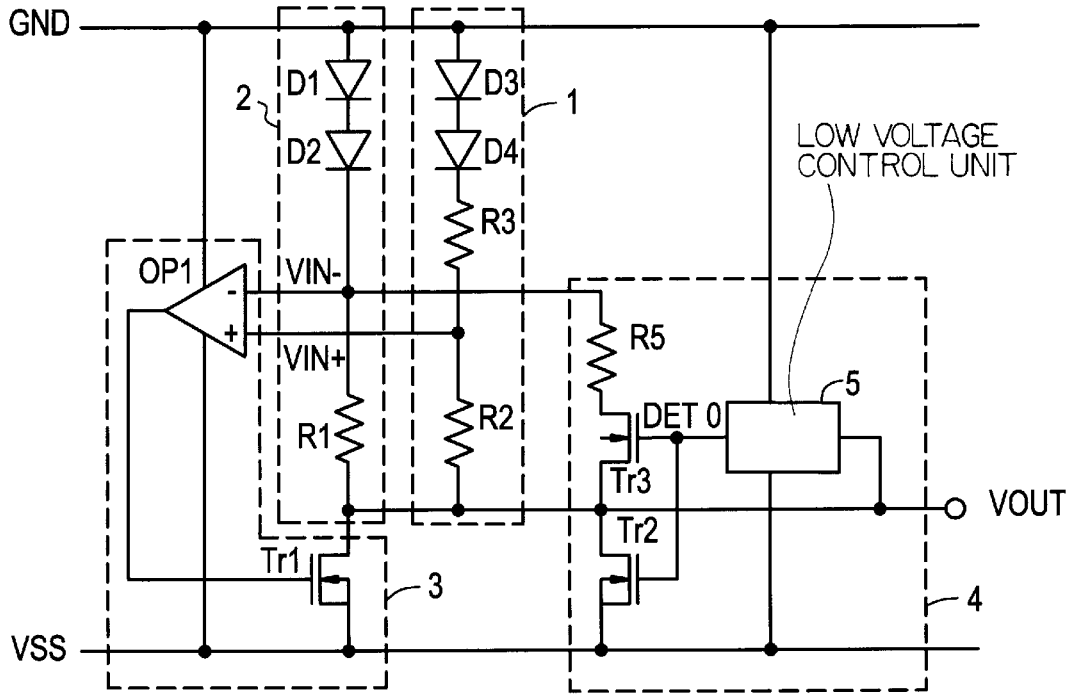
FIGS. 6A and 6B are circuit diagrams for representing a reference voltage generating circuit operated by a negative power supply according to a fifth embodiment of the present invention.
Figure 6B:
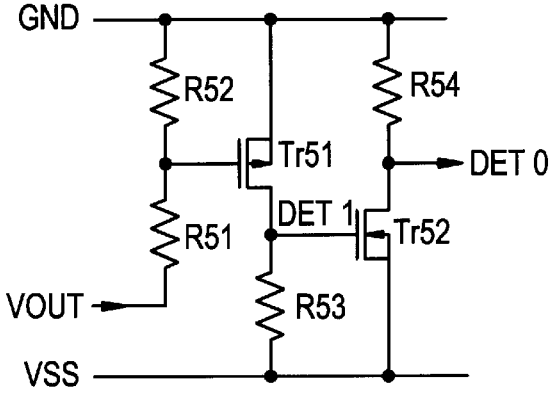

In FIGS. 6A and 6B, when the difference between the reference output voltage VOUT and the ground potential GND is lower than, or equal to a predetermined value, the detection output DET0 is outputted from the low voltage control unit 4, so that the transistors Tr2 and Tr3 are turned ON. As a result, the output of the reverse phase input voltage generating unit 2, namely the reverse phase input terminal VIN− of the operational amplifier OP1, is drawn to the side of the negative power supply voltage VSS, and thus the transistor Tr1 is turned ON by the output of the operational amplifier OP1. Therefore, a voltage substantially equal to the negative power supply voltage VSS is outputted as the reference output voltage VOUT.

Figure 7A:
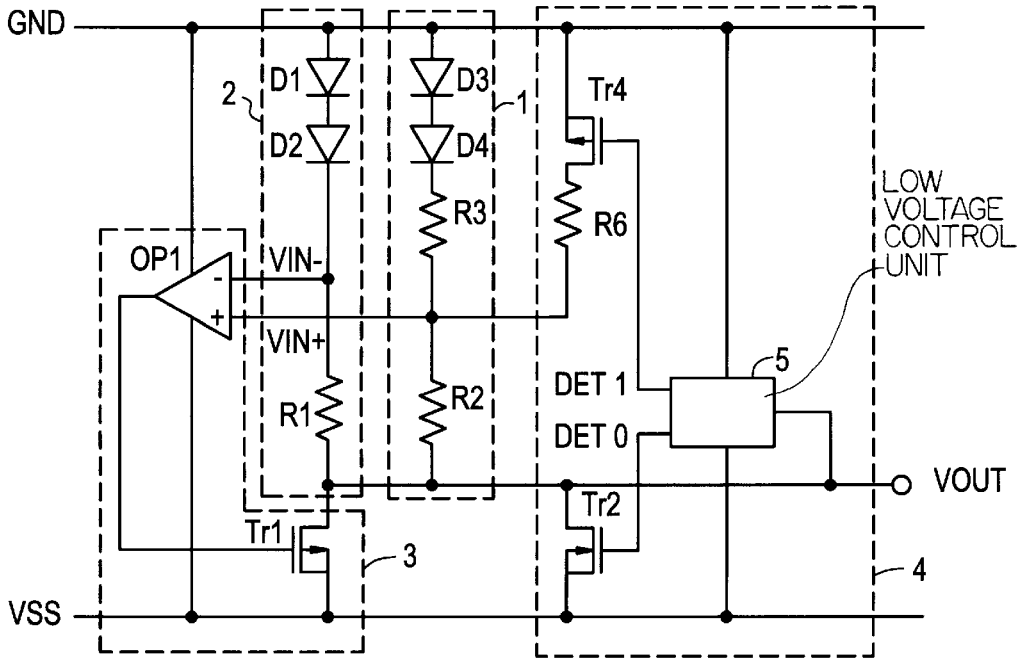
FIGS. 7A and 7B are circuit diagrams for representing another reference voltage generating circuit operated by a negative power supply according to a sixth embodiment of the present invention.
Figure 7B:
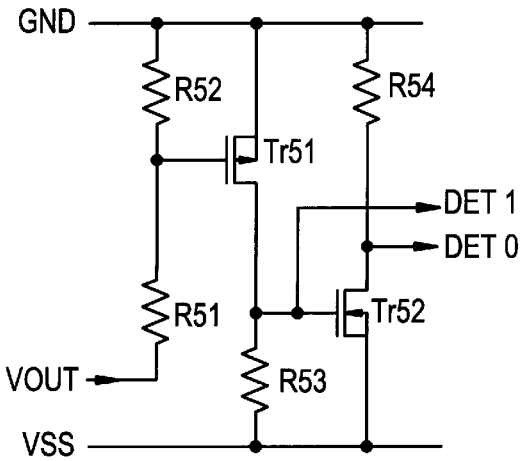

In FIGS. 7A and 7B, when the difference between the reference output voltage VOUT and the ground potential GND is lower than, or equal to a predetermined voltage, the detection output DET1 is outputted from the low voltage control unit 4, so that the transistor Tr4 is turned ON. As a result, the output of the normal phase input voltage generating unit 2, namely the normal phase input terminal VIN+ of the operational amplifier OP1 is drawn to the side of the ground potential, and thus the transistor Tr1 is turned ON by the output of the operational amplifier OP1. Therefore a voltage substantially equal to the negative power supply voltage VSS is outputted as the reference output voltage VOUT.

As previously described in detail, one feature of the present invention has the reference output voltage VOUT pulled to the power supply voltage VDD (VSS) and the reverse phase input voltage VIN− is controlled to be set at a potential higher than the normal phase input voltage VIN+ in the case that the reference output voltage VOUT is lower than a predetermined value. As a consequence, even when the reference output voltage VOUT is lower than a predetermined value while the power supply voltage VDD (VSS) is raised (falling), the reference output voltage VOUT having the potential substantially equal to the power supply voltage VDD (VSS) is outputted. Therefore, even when the power supply voltage VDD (VSS) is gradually increased (decreased), it is possible to obtain such a stable output having the potential substantially equal to the power supply voltage until the reference output voltage VOUT has reached a desirable value. This is better than the conventional reference voltage generating circuit in which when the power supply voltage is increased, the power supply voltage is merely applied from the resistor to the normal phase input voltage generating unit and the reverse phase input voltage generating unit.

It is apparent from the aforementioned specification and the figures that the present invention is not limited to the above embodiments but may be modified and changed without departing from the scope and spirit of the invention. For example, any circuit which will function as necessary to keep the potential of the reverse phase input voltage VIN− at a higher potential than the normal phase input voltage VIN+ can be used as the voltage control unit 4 and the voltage monitoring circuit 5.

What is claimed is:

1. An electronic circuit comprising:

an output terminal;

an output voltage unit including a first input terminal receiving a first input voltage, a second input terminal receiving a second input voltage, and responsive to said first and second input voltage to produce an output voltage and supply said output voltage to said output terminal; and a voltage control unit that receives said output voltage and sets said first input voltage higher than said second input voltage so that said output voltage is substantially the same as a power source voltage when said output voltage is lower than a predetermined voltage, wherein said voltage control unit supplies said power source voltage to said output terminal and supplies a voltage to said first input terminal when said output voltage is lower than said predetermined voltage.

2. The circuit as claimed in claim 1, wherein said voltage control unit comprises:

a first transistor coupled between said output terminal and said first input terminal and having a control gate supplied with a control signal in response to said output voltage.

3. The circuit as claimed in claim 2, wherein said voltage control unit comprises:

a resistance coupled between said output terminal and said first input terminal, in series with said first transistor.

4. The circuit as claimed in claim 2, wherein said voltage control unit comprises a monitor circuit producing said control signal based on said output voltage.

5. The circuit as claimed in claim 4, wherein said power source voltage is higher than a ground potential voltage, when said power source voltage raises from said ground potential voltage, said output voltage is set to be substantially the same as said power source voltage until said output voltage reaches said predetermined voltage, and said first input voltage and said second input voltage become the same so that said output voltage maintains said predetermined voltage after said output voltage substantially reaches said predetermined voltage.

6. The circuit as claimed in claim 2, said output voltage unit includes an amplifier having said first input terminal and said second input terminal, said first input terminal being a normal phase input terminal, said second input terminal being a reverse phase input terminal, and a second transistor responding an output of said amplifier to transfer said power source voltage to said output terminal.

7. The circuit as claimed in claim 1, wherein said voltage control unit directly supplies said power source voltage to said first input terminal when said output voltage is lower than said predetermined voltage.

8. The circuit as claimed in claim 7, wherein said voltage control unit comprises:

a first transistor coupled between a power source line supplying said power source voltage and said first input terminal and having a control gate supplied with a control signal in response to said output voltage.

9. The circuit as claimed in claim 8, wherein said voltage control unit further comprises:

a resistance coupled between said power source line and said first input terminal, in series with said first transistor.

10. The circuit as claimed in claim 1, wherein said voltage control unit supplies a ground potential voltage to said second input voltage when said output voltage is lower than said predetermined voltage.

11. The circuit as claimed in claim 10, wherein said voltage control unit comprises:

a first transistor coupled between a ground potential line supplying said ground potential line and said second input terminal and having a control gate supplied with a control signal in response to said output voltage.

12. The circuit as claimed in claim 11, wherein said voltage control unit further comprises:

a resistance coupled between said ground potential line and said second input terminal in series with said first transistor.

13. An electronic circuit comprising:

an output terminal;

a first input voltage generating unit for producing a first input voltage;

a second input voltage generating unit for producing a second input voltage;

a voltage output unit, including an amplifier having a first input terminal receiving said first input voltage and a second input terminal receiving said second input voltage, and producing an output signal in response to said first and second input voltages;

a voltage control unit for setting said first input voltage to be higher than said second input voltage so that said output voltage is substantially the same as a power source voltage when said output voltage is lower than a predetermined voltage, wherein said voltage control unit supplies said power source voltage to said output terminal and supplies a voltage to said first input terminal when said output voltage is lower than said predetermined voltage; and a first transistor producing said output voltage in response to said output signal;

wherein said first input terminal is a normal phase input terminal, said second input terminal is a reverse phase input terminal, said first input voltage is a normal phase input voltage, and said second input voltage is a reverse phase input voltage.

14. The circuit as claimed in claim 13, wherein said voltage control unit comprises:

a second transistor coupled between said output terminal and said first input terminal and having a control gate supplied with a control signal in response to said output voltage; and a resistance coupled between said output terminal and said first input terminal, in series with said first transistor.

15. The circuit as claimed in claim 13, wherein said voltage control unit directly supplies said power source voltage to said first input terminal when said output voltage is lower than said predetermined voltage.

16. The circuit as claimed in claim 13, wherein said voltage control unit supplies a ground potential voltage to said second input terminal when said output voltage is lower than said predetermined voltage.

17. The circuit as claimed in claim 16, wherein said voltage control unit comprises:

a second transistor coupled between a ground potential line supplying said ground potential to said second input terminal and having a control gate supplied with a control signal in response to said output voltage; and a resistance coupled between said ground potential line and said second input terminal, in series with said first transistor.

18. A semiconductor circuit comprising:

a first power source line;

a second power source line;

an output terminal;

a first input voltage generating unit coupled between said output terminal and said second power source line, and generating a first input voltage;

a second input voltage generating unit coupled between said output terminal and said second power source line, and generating a second input voltage;

a voltage output unit responding said first and second input voltages to produce an output voltage and supply said output voltage to said output terminal; and a voltage control unit including:

a voltage monitoring circuit producing a control signal according to said output voltage;

a first transistor coupled between said first power source line and said output terminal and having a gate electrode inputting said control signal; and a second transistor coupled between said second power source line and said second input voltage generating unit and having a gate electrode inputting said control signal.

19. The circuit as claimed in claim 18, wherein said first input voltage is a normal phase input voltage, said second input voltage is a reverse phase input voltage, and said voltage output unit includes an amplifier having a normal phase input terminal receiving said normal phase input voltage, a reverse phase input terminal receiving said reverse phase input voltage, an output node, and a third transistor coupled between said first power source line and said output terminal and having a control gate coupled to said output node of said amplifier.

20. The circuit as claimed in claim 19, wherein said first input voltage generating circuit includes at least one resistance element and at least one diode element, said second input voltage generating circuit includes at least one resistance element and at least one diode element.

21. The circuit as claimed in claim 19, wherein said first power source line is supplied with a positive power source voltage and said second power source line is supplied with a ground potential voltage.

22. The circuit as claimed in claim 19, wherein said first power source line is supplied with a negative power source voltage and said second power source line is supplied with a ground potential voltage.

* * * * *